US008607557B2

(12) United States Patent
Ikeda et al.

(10) Patent No.: US 8,607,557 B2
(45) Date of Patent: Dec. 17, 2013

(54) HYDRAULIC CONTROL SYSTEM FOR EXCAVATOR

(75) Inventors: Toshimichi Ikeda, Changwon-si (KR); Yang Koo Lee, Changwon-si (KR)

(73) Assignee: Volvo Construction Equipment Holding Sweden AB, Eskilstuna (SE)

( * ) Notice: Subject to any disclaimer, the term of this patent is extended or adjusted under 35 U.S.C. 154(b) by 820 days.

(21) Appl. No.: 12/796,847

(22) Filed: Jun. 9, 2010

(65) Prior Publication Data

US 2010/0319338 A1 Dec. 23, 2010

(30) Foreign Application Priority Data

Jun. 22, 2009 (KR) ..... 10-2009-0055443

(51) Int. Cl.
*F16D 31/02* (2006.01)

(52) U.S. Cl.
USPC ..... 60/421; 60/422; 60/429; 60/471

(58) Field of Classification Search
USPC ..... 60/468, 471, 484, 483, 486, 421, 422, 60/429
See application file for complete search history.

(56) References Cited

U.S. PATENT DOCUMENTS 4,531,366 A * 7/1985 Moriya et al. ..... 60/421

FOREIGN PATENT DOCUMENTS

JP 58034205 A * 2/1983

* cited by examiner

*Primary Examiner* — Edward Look
*Assistant Examiner* — Logan Kraft
(74) *Attorney, Agent, or Firm* — Ladas & Parry LLP

(57) ABSTRACT

A hydraulic circuit for an excavator is provided, which includes at least one first working device control valve having a first traveling control valve and a first boom control valve successively installed along a first center bypass line from a downstream side of a first hydraulic pump, at least one second working device control valve having a second traveling control valve and a second boom control valve successively installed along a second center bypass line from a downstream side of a second hydraulic pump, a third hydraulic pump providing fluid pressure to a swing motor installed on a third center bypass line, a swing control valve installed on a downstream side of the third hydraulic pump and shifted, in accordance with a valve switching signal input from the outside, to supply hydraulic fluid discharged from the third hydraulic pump to the swing motor, and a boom confluence line connected between an output port of the swing control valve and an input port of the boom control value to make the hydraulic fluid discharged from the third hydraulic pump join hydraulic fluid on the input port side of the boom control valve through the third center bypass line when the direction of the boom control valve is changed.

2 Claims, 3 Drawing Sheets

HYDRAULIC CONTROL SYSTEM FOR EXCAVATOR

CROSS-REFERENCE TO RELATED APPLICATION

This application is based on and claims priority from Korean Patent Application No. 10-2009-55443, filed on Jun. 22, 2009 in the Korean Intellectual Property Office, the disclosure of which is incorporated herein in its entirety by reference.

BACKGROUND OF THE INVENTION

1. Field of the Invention

The present invention relates to a hydraulic control system for an excavator having a swing-independent hydraulic circuit. More particularly, the present invention relates to a hydraulic control system for an excavator provided with an improved swing-independent hydraulic circuit, which can independently control a swing motor, and efficiently utilize the hydraulic capability of a swing drive system by making the hydraulic fluid being supplied from a swing hydraulic pump join the hydraulic fluid in working devices when the working devices, such as a boom, an arm, and the like, are compositely driven.

2. Description of the Prior Art

In heavy construction equipment, such as an excavator, a loader, and the like, diverse attempts to efficiently control the horsepower or fluid pressure of an engine have been made, and in the case of compositely operating a swing structure and a working device, such as a boom, an arm, or a bucket, it is required to efficiently control not only the engine but also the hydraulic system.

A typical hydraulic control system for an excavator having a confluence circuit for connecting a hydraulic pump, a traveling device, and working devices has been disclosed. In order to heighten the operation speed and the manipulation of the respective working devices, the confluence circuit makes the hydraulic fluid in the hydraulic pump connected to the traveling device join the hydraulic fluid in the working devices, and thus the hydraulic circuit becomes complicated.

FIG. 1 is a view schematically illustrating a conventional excavator that is heavy construction equipment, and FIG. 2 is a view schematically illustrating the construction of a hydraulic system for the excavator as illustrated in FIG. 1.

According to the excavator as illustrated in FIG. 1, an upper swing structure 1 is mounted on an upper part of a lower driving structure 2, and on the upper swing structure 1, a cab 3 installed in front of an engine room 4, and working devices including a boom 5, an arm 7, and a bucket 7, are mounted.

Typically, in the engine room 4, an engine, a radiator, a radiator fan, an oil cooler, and an oil cooler fan are installed, and a main pump and a small pump for operating the oil cooler fan and the radiator fan pump the hydraulic fluid from a hydraulic tank T through the rotation of the engine. Also, plural actuators including a boom cylinder 9, an arm cylinder 11, a bucket cylinder 13, a swing motor, and so on, are driven by the fluid pressure of the hydraulic fluid discharged from hydraulic pumps 201 and 206.

Referring to FIG. 2, the first hydraulic pump 201 supplies the hydraulic fluid to a first traveling control valve 202, a first boom control valve 203, a first swing control valve 204, and a first arm control valve 205.

Also, the second hydraulic pump 206 supplies the hydraulic fluid to a second traveling control valve 207, a second boom control valve 208, a second bucket control valve 209, and a second arm control valve 210. Accordingly, the first traveling control valve 202 controls a left traveling motor 211 in accordance with the fluid pressure applied from the first hydraulic pump 201, and the second traveling control valve 207 controls a right traveling motor 212 in accordance with the fluid pressure applied from the second hydraulic pump 206. The bucket cylinder 13 is controlled by the second bucket control valve 209, the boom cylinder 9 is controlled by the respective boom control valves 203 and 208, and the arm cylinder 12 is controlled by the respective arm control valves 205 and 208.

In the parallel hydraulic circuits using two hydraulic pumps as described above, the hydraulic fluid flows to a side where the resistance caused by the fluid pressure is high, and thus a relatively low fluid pressure appears in a circuit having a high resistance. Accordingly, in the case of compositely operating the swing motor and the arm, or the swing motor and the boom, the actuator may not operate smoothly to lower the driving speed of the actuator.

Particularly, if an actuator for another working device is driven while the fluid pressure is required for the swing operation, the fluid pressure being applied to the swing motor is decreased to lower the original swing speed. Accordingly, in order to perform an efficient composite operation, a swing-independent hydraulic control system, in which the fluid pressure is provided through a separate hydraulic pump, is required so that the swing motor is not affected by other actuators.

However, as illustrated in FIG. 3, the conventional swing-independent hydraulic control system has the drawback that, although the performance of swing composite operations is improved through the independent control of the swing motor 204, it is inefficient in controlling the flow rate or the horsepower of the engine. That is, since the swing motor 204 is not used in the case of performing the digging operation, the third hydraulic pump 213 is in an idle state, and this causes the performance of the flow rate control to be lowered.

In addition, although the performance can be maintained in the case where the boom, the arm, and the like, are compositely operated by the first and second hydraulic pumps, respectively, it is impossible to use the fluid pressure of the third hydraulic pump required for the actuator in the case where the swing motor and the boom, or the swing motor and the arm are compositely operated.

SUMMARY OF THE INVENTION

Accordingly, the present invention has been made to solve the above-mentioned problems occurring in the prior art while advantages achieved by the prior art are maintained intact.

One subject to be achieved by the present invention is to provide a hydraulic control system for an excavator having a swing-independent hydraulic circuit, which can independently control a swing motor, and improve the composite manipulation performance of working devices by using the fluid pressure of a hydraulic pump for a swing operation as well.

In order to accomplish this subject, there is provided a hydraulic control system for an excavator including an upper swing structure, a lower driving structure, first and second hydraulic pumps which provide fluid pressure to a plurality of working device actuators including a boom cylinder installed on the upper swing structure, an arm cylinder, a bucket cylinder, and a swing motor, according to an embodiment of the present invention, which includes at least one first working device control valve having a first traveling control valve and a first boom control valve successively installed along a first center bypass line from a downstream side of the first hydraulic pump; at least one second working device control valve having a second traveling control valve and a second boom control valve successively installed along a second center bypass line from a downstream side of the second hydraulic pump; a third hydraulic pump providing fluid pressure to the swing motor that is installed on a third center bypass line; a swing control valve installed on a downstream side of the third hydraulic pump and shifted, in accordance with a valve switching signal input from the outside, to supply hydraulic fluid discharged from the third hydraulic pump to the swing motor; and a boom confluence line connected and installed between an output port of the swing control valve and an input port of the boom control value to make the hydraulic fluid discharged from the third hydraulic pump join hydraulic fluid on the input port side of the boom control valve through the third center bypass line when the direction of the boom control valve is changed.

In the hydraulic control system for an excavator according to an embodiment of the present invention, the boom confluence line is connected to and installed on a flow path between the input port of the second boom control valve and the second hydraulic pump.

In another aspect of the present invention, there is provided a hydraulic control system for an excavator including an upper swing structure, a lower driving structure, first and second hydraulic pumps which provide fluid pressure to a plurality of working device actuators including a boom cylinder installed on the upper swing structure, an arm cylinder, a bucket cylinder, and a swing motor, according to an embodiment of the present invention, which includes at least one first working device control valve having a first traveling control valve and a first boom control valve successively installed along a first center bypass line from a downstream side of the first hydraulic pump; at least one second working device control valve having a second traveling control valve and a second boom control valve successively installed along a second center bypass line from a downstream side of the second hydraulic pump; a third hydraulic pump providing fluid pressure to the swing motor that is installed on a third center bypass line; a swing control valve installed on a downstream side of the third hydraulic pump and shifted, in accordance with a valve switching signal input from the outside, to supply hydraulic fluid discharged from the third hydraulic pump to the swing motor; a confluence control valve connected to and installed on a flow path between the swing control valve installed on the third center bypass line at the downstream of the third hydraulic pump and at least one of the working device control valves connected to the first and second center bypass lines, and shifted, in accordance with the valve switching signal input from the outside when the swing control valve is in a neutral position, to supply the hydraulic fluid discharged from the third hydraulic pump to at least one of the working device control valves selectively connected; and variable confluence lines connected and installed between an output port side of the confluence control valve and the at least one of the working device control valves selectively connected to make the hydraulic fluid supplied from the third hydraulic pump join the hydraulic fluid in the first or second hydraulic pump in accordance with spool shifting of the confluence control valve.

In the hydraulic control system for an excavator according to another embodiment of the present invention, the variable confluence lines are connected to and installed on a flow path between an output port of the second arm control valve and the arm cylinder.

The hydraulic control system for an excavator according to another embodiment of the present invention may further include a bucket control valve connected to and installed in a flow path branched from the second center bypass line on the downstream side of the second hydraulic pump, and shifted, in accordance with the valve switching signal inputted from the outside, to control the hydraulic fluid of the second hydraulic pump being supplied to a bucket cylinder.

With the above-described construction, the hydraulic control system for an excavator according to the embodiments of the present invention can independently control the swing motor by the fluid pressure being applied through the second hydraulic pump, and keep the speed of actuators without insufficiency of the flow rate during the swing composite operation through joining of the hydraulic fluid from the hydraulic pump for the swing operation and the hydraulic fluid from the working devices such as the boom, arm, and the like.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Figure 1:
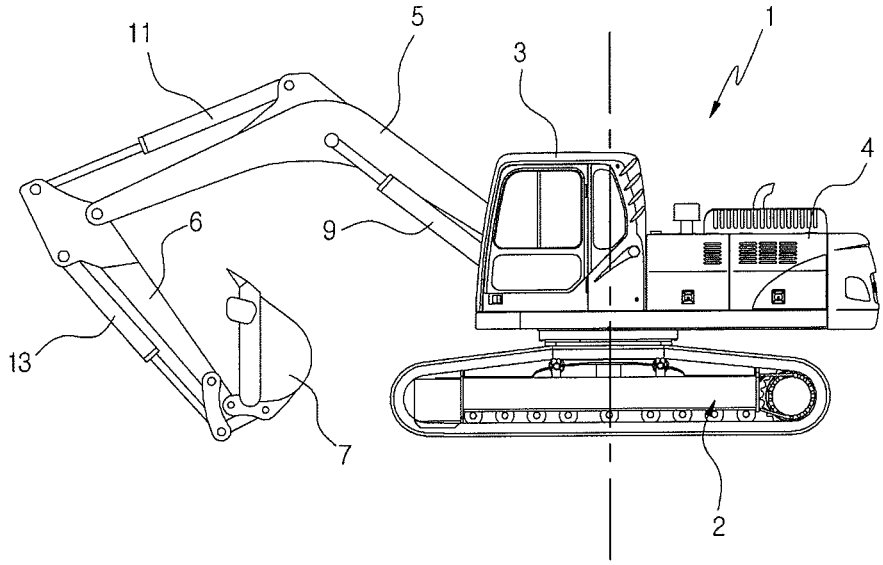
FIG. 1 PRIOR ART
FIG. 1 is a view schematically illustrating an excavator in the related art.

Hereinafter, preferred embodiments of the present invention will be described with reference to the accompanying drawings. The matters defined in the description, such as the detailed construction and elements, are nothing but specific details provided to assist those of ordinary skill in the art in a comprehensive understanding of the invention, and thus the present invention is not limited thereto. The same drawing reference numerals are used for the same elements across various figures.

Figure 2:
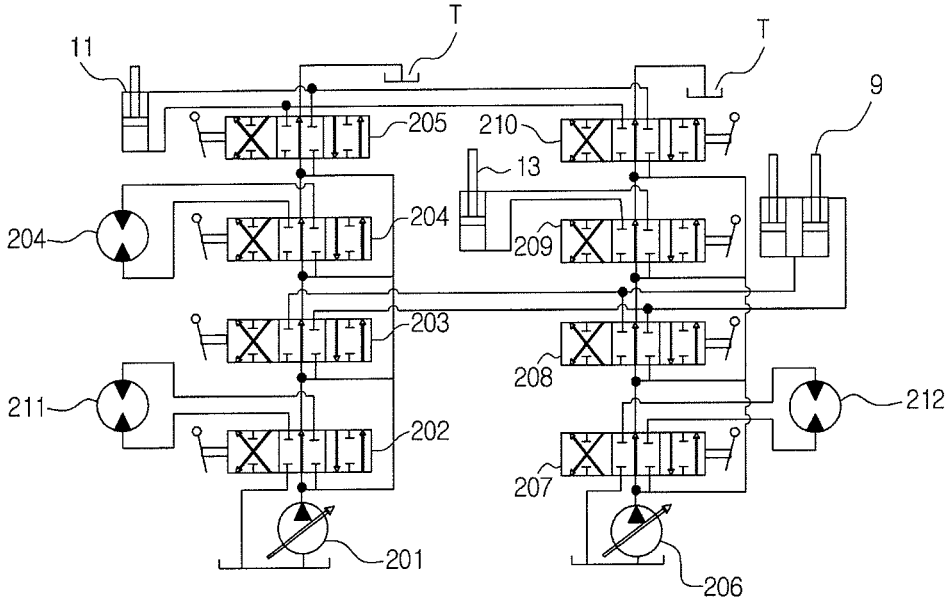
FIG. 2 PRIOR ART
FIG. 2 is a circuit diagram of a two-pump type hydraulic circuit generally adopted in an excavator in the related art.
Figure 3:
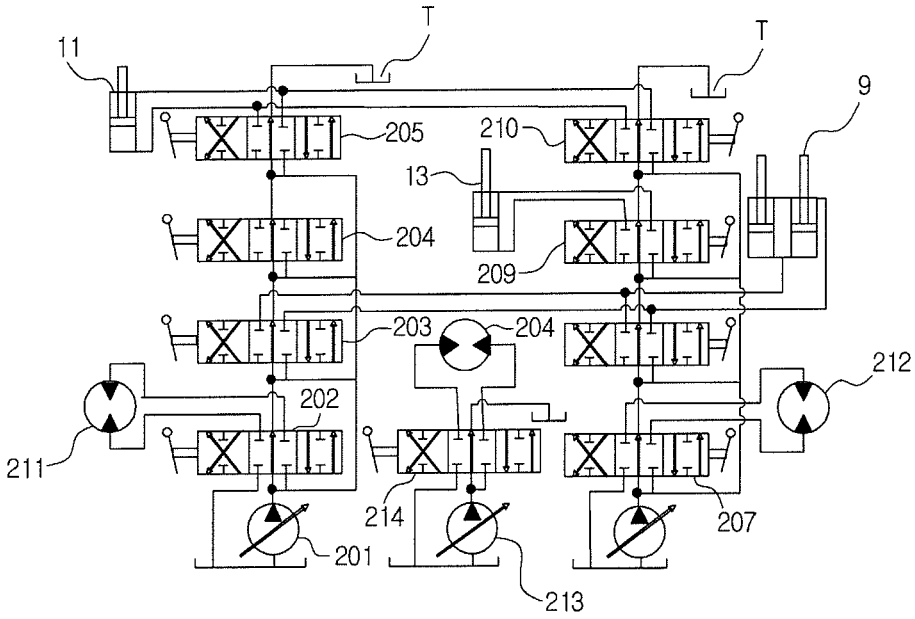
FIG. 3 PRIOR ART
FIG. 3 is a circuit diagram of a swing-independent hydraulic system for an excavator in the related art.
Figure 4:
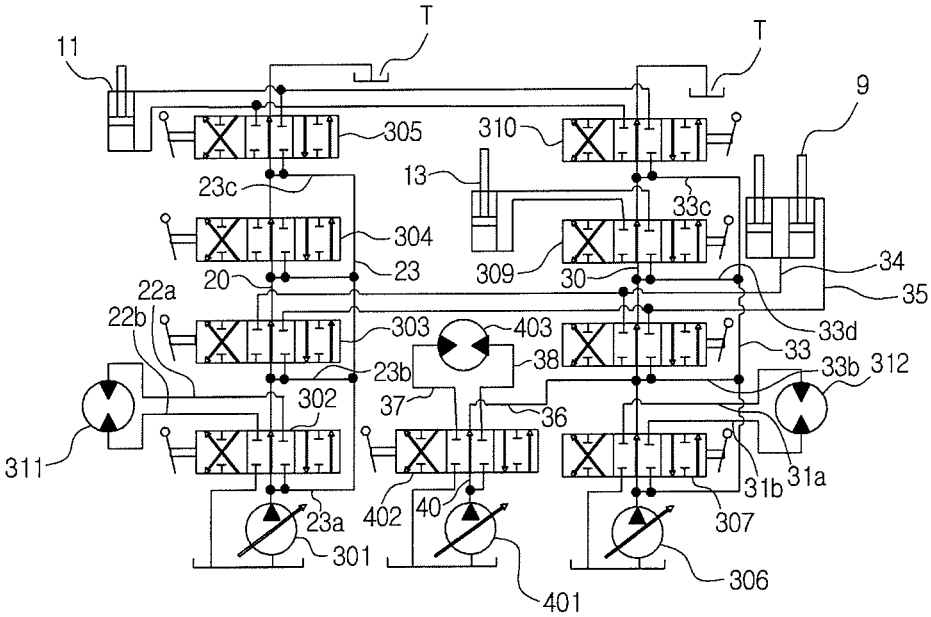
FIG. 4 is a circuit diagram of a hydraulic control system for an excavator confluent with a boom control valve according to an embodiment of the present invention.

FIG. 1 is a view schematically illustrating an excavator in the related art, FIG. 2 is a circuit diagram of a two-pump type hydraulic circuit generally adopted in an excavator in the related art, and FIG. 3 is a circuit diagram of a swing-independent hydraulic system for an excavator in the related art. FIG. 4 is a circuit diagram of a hydraulic control system for an excavator confluent with a boom control valve according to an embodiment of the present invention, and FIG. 5 is a circuit diagram of a hydraulic control system for an excavator confluent with an arm control valve according to another embodiment of the present invention.

In the drawings, the reference numeral "36" denotes a boom confluence flow path, "401" denotes a third hydraulic pump, "402" denotes a swing control valve, "403" denotes a swing motor, and "501" denotes a confluence control valve. A working device control valve is a term that limits a hydraulic element that controls hydraulic fluid discharged from a hydraulic pump to control an actuator of a working device for typical heavy construction equipment that includes a boom, an arm, a bucket, a breaker, and the like.

As illustrated in FIG. 4, a hydraulic control system for an excavator including an upper swing structure 1, a lower driving structure 2, and first and second hydraulic pumps 301 and 306 which provide fluid pressure to a plurality of working device actuators including a boom cylinder 9 installed on the upper swing structure 1, an arm cylinder 11, a bucket cylinder 13, and a swing motor 403, according to an embodiment of the present invention, which includes at least one first working device control valve 303, 304, and 305 having a first traveling control valve 302 and a first boom control valve 303 successively installed along a first center bypass line 20 from a downstream side of the first hydraulic pump 301; at least one second working device control valve 309 and 310 having a second traveling control valve 307 and a second boom control valve 308 successively installed along a second center bypass line 30 from a downstream side of the second hydraulic pump 306; a third hydraulic pump 401 providing fluid pressure to the swing motor 403 that is installed on a third center bypass line 40; a swing control valve 402 installed on a downstream side of the third hydraulic pump 401 and shifted, in accordance with a valve switching signal input from the outside, to supply hydraulic fluid discharged from the third hydraulic pump 401 to the swing motor 403; and a boom confluence line 36 connected and installed between an output port of the swing control valve 402 and an input port of the boom control value 308 to make the hydraulic fluid discharged from the third hydraulic pump 401 join hydraulic fluid on the input port side of the boom control valve 308 through the third center bypass line 40 when the direction of the boom control valve is changed.

Figure 5:
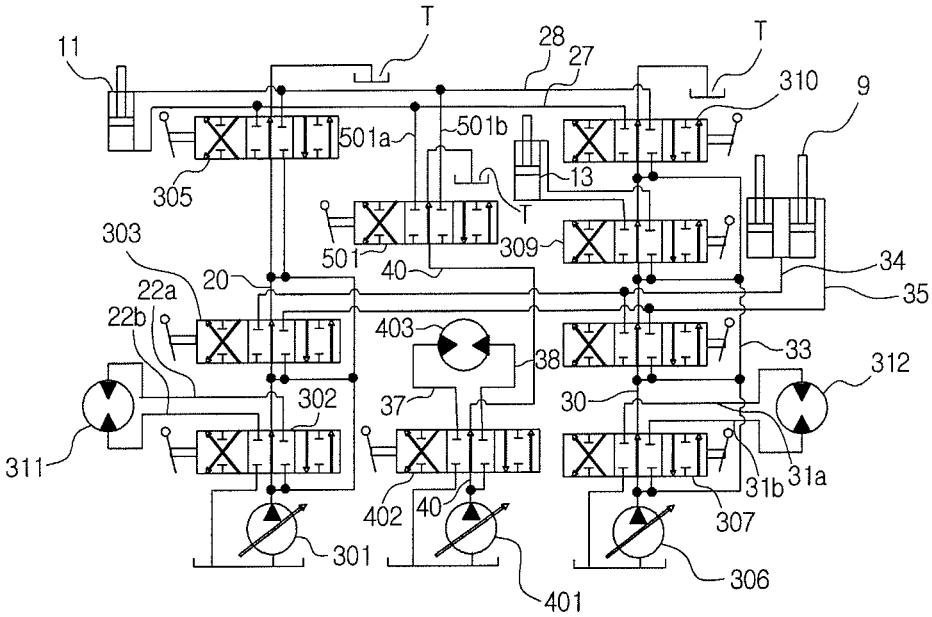
FIG. 5 is a circuit diagram of a hydraulic control system for an excavator confluent with an arm control valve according to another embodiment of the present invention.

Also, as illustrated in FIG. 5, a hydraulic control system for an excavator including an upper swing structure 1, a lower driving structure 2, and first and second hydraulic pumps 301 and 306 which provide fluid pressure to a plurality of working device actuators including a boom cylinder 9 installed on the upper swing structure 1, an arm cylinder 11, a bucket cylinder 13, and a swing motor 403, according to an embodiment of the present invention, which includes at least one first working device control valve 303, 304, and 305 having a first traveling control valve 302 and a first boom control valve 303 successively installed along a first center bypass line 20 from a downstream side of the first hydraulic pump 301; at least one second working device control valve 309 and 310 having a second traveling control valve 307 and a second boom control valve 308 successively installed along a second center bypass line 30 from a downstream side of the second hydraulic pump 306; a third hydraulic pump 401 providing fluid pressure to the swing motor 403 that is installed on a third center bypass line 40; a swing control valve 402 installed on a downstream side of the third hydraulic pump 401 and shifted, in accordance with a valve switching signal input from the outside, to supply hydraulic fluid discharged from the third hydraulic pump 401 to the swing motor 403; a confluence control valve 501 connected to and installed on a flow path between the swing control valve 402 installed on the third center bypass line 40 at the downstream of the third hydraulic pump 401 and at least one of the working device control valves 303, 304, 305, 309, and 310 connected to the first and second center bypass lines 20 and 30, and shifted, in accordance with the valve switching signal input from the outside when the swing control valve 402 is in a neutral position, to supply the hydraulic fluid discharged from the third hydraulic pump 401 to at least one of the working device control valves 303, 304, 305, 309, and 310 selectively connected; and variable confluence lines 501*a* and 501*b* connected and installed between an output port side of the confluence control valve 501 and the at least one of the working device control valves 303, 304, 305, 309, and 310 selectively connected to make the hydraulic fluid supplied from the third hydraulic pump 401 join the hydraulic fluid in the first or second hydraulic pump 301 or 306 in accordance with spool shifting of the confluence control valve 501.

The hydraulic control system for an excavator according to the embodiments of the present invention further includes a bucket control valve 309 connected to and installed in a flow path 33*d* branched from the second center bypass line 30 on the downstream side of the second hydraulic pump 306, and shifted, in accordance with the valve switching signal inputted from the outside, to control the hydraulic fluid of the second hydraulic pump 306 being supplied to the bucket cylinder 13.

It is preferable that the boom confluence line 36 is connected to and installed on a flow path 33*b* between the input port of the second boom control valve 308 and the second hydraulic pump 306.

Also, it is preferable that the variable confluence lines 501*a* and 501*b* are connected to and installed on flow paths 27 and 28 between an output port of the second arm control valve 310 and the arm cylinder 11. However, diverse modifications are possible so as to make the hydraulic fluid discharged from the third hydraulic pump 401 join the hydraulic fluid on the side of the bucket cylinder 13 or another working device actuator.

In the construction according to the embodiments of the present invention, a branch flow path 23 that is branched from the first center bypass line 20 is installed between the first hydraulic pump 301 and the first arm control valve 305, and the branch flow path 23 is connected to and installed on a plurality of flow paths 23*a*, 23*b*, and 23*c* which are respectively connected to input port sides of at least one of the first working device control valves 303, 304, and 305 including the first arm control valve 305.

The flow paths 23*a*, 23*b*, and 23*c* are connected to and installed on the input port sides of the first traveling control valve 302, the first boom control valve 303, and the first arm control valve 305, respectively.

Also, a branch flow path 33 that is branched from the second center bypass line 30 is installed between the second hydraulic pump 306 and the second arm control valve 310, and the branch flow path 33 is connected to and installed on a plurality of flow paths 33*a*, 33*b*, 33*c*, and 33*d* which are respectively connected to input port sides of at least one of the second working device control valves 307, 308, 309, and 310 including the second arm control valve 310.

The flow paths 33*a*, 33*b*, and 33*c* are installed on the input port sides of the second traveling control valve 307, second boom control valve 308, and second arm control valve 310, and the flow path 33*d* is connected to and installed on the input port side of the bucket control valve 309.

Hereinafter, the operation and effect of the hydraulic control system for an excavator according to an embodiment of the present invention will be described with reference to the accompanying drawings.

First, in the hydraulic control system for an excavator according to the present invention, when a valve switching signal provided from an outside is inputted for the swing operation, e.g., if a pilot signal is inputted through a pedal or joystick (not illustrated), the spool of the swing control valve 402 is shifted to the left or right, and thus a swing-independent hydraulic control is performed to provide the hydraulic fluid from the third hydraulic pump 401 to the swing motor 403 through flow paths 37 and 38.

In the hydraulic control system for an excavator according to the present invention as illustrated in FIG. 4, the swing motor 403 separately receives the hydraulic fluid from the third hydraulic pump 401, and thus the swing-independent hydraulic control becomes possible. At this time, the left and right traveling devices 311 and 312 are controlled by the spool shifting of the traveling control valves 302 and 307 so that they receive the hydraulic fluid by the first hydraulic pump 301 and the second hydraulic pump 306, without being affected by the third hydraulic pump 401.

Particularly, in the case of heightening the speed of the boom actuator for the ascending/descending or pull-up operation of the boom, spools of the first and second boom control valves 303 and 308 are first shifted to the left or right, as shown in the drawing, by the valve switching signal input from the outside, and the hydraulic fluid from the first hydraulic pump 301 and the second hydraulic pump 306 are supplied to a large chamber or a small chamber through flow paths 34 and 35 in accordance with the spool shifting.

At this time, since the hydraulic fluid from the third hydraulic pump 401 is supplied from the neutral position of the swing control valve 402 to the inlet port of the second boom control valve 308 through the confluence line 36 connected to the third center bypass line 40 and the flow path 33*b*, the hydraulic fluid from the second hydraulic pump 306 and the hydraulic fluid from the third hydraulic pump 401 join together to be supplied to the boom cylinder 9, and the speed of the actuator can be kept at maximum even if high load is generated.

However, although not illustrated in the drawing, in the case where the confluence line 36 is connected to and installed on the inlet port side of the first boom control valve 303, the hydraulic fluid from the third hydraulic pump 401 and the hydraulic fluid from the first hydraulic pump 301 join together, and are supplied to the large chamber and the small chamber of the boom cylinder 9 in accordance with the spool shifting of the first boom control valve 303, so that the actuator speed can be increased.

According to the hydraulic control system for an excavator according to the present invention, when the valve switching signal is inputted from the outside for the swing operation, the spool of the swing control valve 402 is shifted to the right or left, and the confluence line 36 connected to the third center bypass line 40 is intercepted. At this time, the hydraulic fluid discharged from the third hydraulic pump 401 is supplied to the swing motor 403 through the flow paths 37 and 38, and thus the operation of the swing motor 403 can be controlled independently, without being affected by the first hydraulic pump 301 or the second hydraulic pump 306.

With reference to FIG. 5, the hydraulic control system for an excavator according to another embodiment of the present invention will now be described.

As the spool of the second arm control valve 310 is shifted to the left or right in accordance with the valve switching signal inputted from the outside, the operation of the arm cylinder 11 is controlled. In this case, the hydraulic fluid from the second hydraulic pump 306 is supplied through flow paths 27 and 28 connected between the outlet port of the second arm control valve 310 and the arm cylinder 11. Here, in accordance with the spool shifting of the confluence control valve 501, the driving speed of the arm cylinder 11 can be heightened.

That is, if the swing control valve 402 is in the neutral state and the spool of the confluence control valve 501 is shifted to the left or right in accordance with the valve switching signal inputted from the outside, the hydraulic fluid from the third hydraulic pump 401 joins the hydraulic fluid in the flow paths 27 and 28 connected between the outlet port of the second arm control valve 310 and the arm cylinder 11 through the confluence lines 501*a* and 501*b*, and is supplied to the large chamber and the small chamber of the arm cylinder 11.

Accordingly, the hydraulic fluid from the second hydraulic pump 306 joins the hydraulic fluid discharged from the third hydraulic pump 401, and thus sufficient hydraulic fluid is supplied to the arm cylinder 11. The driving speed of the actuator can be kept at maximum without insufficient flow rate or hunting phenomenon even if high load is generated.

On the other hand, if the traveling control valves 302 and 307 are shifted by the valve switching signal inputted from the outside, except for the confluence circuit according to the present invention, the hydraulic fluid from the first hydraulic pump 301 and the hydraulic fluid from the second hydraulic pump 306 are supplied and return to the traveling devices 311 and 312 through the flow paths 21, 22, 31, and 32, respectively, and thus the straight or left/right traveling of the equipment can be controlled. Also, in the case of controlling the swing operation of the equipment, the hydraulic fluid from the third hydraulic pump 401 is supplied to the swing motor 403 through the flow paths 37 and 38, and if both the swing control valve 402 and the confluence control valve 501 are shifted to the neutral state, the hydraulic fluid from the third hydraulic pump 401 is returned to the hydraulic tank T.

In the embodiments of the present invention, since the operation principle that the hydraulic fluid discharged from the second hydraulic pump 306 is supplied to the large chamber or the small chamber of the bucket cylinder 12 via the flow paths 29*a* and 29*b* in accordance with the spool shifting of the bucket control valve 309, and is returned to the hydraulic tank T when the spool of the bucket control valve is in a neutral position, is substantially the same as the operation principle of a typical hydraulic system for heavy construction equipment, the detailed description thereof will be omitted.

Although preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A hydraulic control system for an excavator including an upper swing structure, a lower driving structure, first and second hydraulic pumps which provide fluid pressure to a plurality of working device actuators including a boom cylinder installed on the upper swing structure, an arm cylinder, a bucket cylinder, and a swing motor, the hydraulic control system comprising:

at least one first working device control valve having a first traveling control valve and a first boom control valve successively installed along a first center bypass line from a downstream side of the first hydraulic pump;

at least one second working device control valve having a second traveling control valve and a second boom control valve successively installed along a second center bypass line from a downstream side of the second hydraulic pump;

a third hydraulic pump providing fluid pressure to the swing motor that is installed on a third center bypass line;

a swing control valve installed on a downstream side of the third hydraulic pump and shifted, in accordance with a valve switching signal input from the outside, to supply hydraulic fluid discharged from the third hydraulic pump to the swing motor;

a confluence control valve connected to and installed on a flow path between the swing control valve installed on the third center bypass line at the downstream of the third hydraulic pump and at least one of the working device control valves connected to the first and second center bypass lines, and shifted, in accordance with the valve switching signal input from the outside when the swing control valve is in a neutral position, to supply the hydraulic fluid discharged from the third hydraulic pump to at least one of the working device control valves selectively connected; and variable confluence lines connected and installed between an output port side of the confluence control valve and the at least one of the working device control valves selectively connected to make the hydraulic fluid supplied from the third hydraulic pump join the hydraulic fluid in the first or second hydraulic pump in accordance with spool shifting of the confluence control valve, wherein the variable confluence lines are connected to and installed on a flow path between an output port of a second arm control valve and the arm cylinder.

2. The hydraulic control system according to claim 1, further comprising a bucket control valve connected to and installed in a flow path branched from the second center bypass line on the downstream side of the second hydraulic pump, and shifted, in accordance with the valve switching signal inputted from the outside, to control the hydraulic fluid of the second hydraulic pump being supplied to a bucket cylinder.

* * * * *